United States Patent [19]

Cox et al.

[11] 4,227,481

[45] Oct. 14, 1980

[54] SAFETY STEERING SYSTEM FOR OUTBOARD MOTORS

[76] Inventors: Burton B. Cox, 11750 S. 85th E. Ave., Bixby, Okla. 74008; Peter F. Maroney, 12634 S. 123rd E. Ave., Broken Arrow, Okla. 74012

[21] Appl. No.: 951,195

[22] Filed: Oct. 13, 1978

[51] Int. Cl.[3] ..... B63H 21/26

[52] U.S. Cl. ..... 440/61; 91/437; 91/466; 114/144 R

[58] Field of Search ..... 114/144 R, 144 A, 150, 114/151, 170, 171, 172; 115/18 R, 41 R, 35; 91/437, 466

[56] References Cited

U.S. PATENT DOCUMENTS

| | | | |
|---|---|---|---|
| 2,615,433 | 10/1952 | Deardorff et al. | 91/466 X |
| 2,968,282 | 1/1961 | Hayman et al. | 91/437 |
| 3,631,833 | 1/1972 | Shimanckas | 115/18 R |
| 3,658,027 | 4/1972 | Sturges | 115/18 R |

*Primary Examiner*—Charles E. Frankfort
*Attorney, Agent, or Firm*—William S. Dorman

[57] ABSTRACT

A safety steering system to control torque rotation for boats having directable propeller outboard motors capable of pivoting about a vertical axis. An arm extending from the motor is connected to a flexible cable having two ends, a first end connected to a steering device and a second end connected to the arm. An actuator control valve interposed along the flexible cable is capable of locking the arm in a single position when no force from the cable is being exerted on the arm. The control valve has a valve body with a central bore therethrough and a first external port and a second external port in fluid communication with the central bore. A hydraulic piston-cylinder is connected between the end of the motor arm and a tab in the motor well. The hydraulic cylinder has a first chamber of confined liquid and a second chamber of confined liquid. A piston reciprocal within the cylinder is capable of moving longitudinally therein and includes a piston head separating the first liquid chamber from the second liquid chamber. Liquid may be conducted from the first chamber to the first external port on the control valve. Liquid may also be conducted from the second liquid chamber to the second external port on the control valve. A stem within the control valve responsive to a push force or pull force from the cable provides communication within the control valve between the external ports and is movable in response to the cessation of the push force or the pull force by release of the steering device to interrupt communication between the external ports; thus, the hydraulic piston-cylinder will lock the motor in a fixed position.

2 Claims, 7 Drawing Figures

SAFETY STEERING SYSTEM FOR OUTBOARD MOTORS

BACKGROUND OF THE INVENTION

1. Field of the Invention

This invention relates to a system for safe steering of motor boats having directable propeller outboard motors. More particularly, this invention relates to a system for safe steering of motor boats to prevent the torque of the outboard motor from causing the boat to go out of control if the helmsman takes his or her hands off the steering wheel.

2. Description of the Prior Art

Motor boats containing outboard motors frequently have steering mechanisms whereby the outboard motor and the propeller extending therefrom are pivoted in relation to the boat about a vertical axis. Steering of the boat is accomplished through use of a flexible cable which is capable of exerting a pushing force as well as a pulling force. The flexible cable is connected to a steering wheel located at the forward end of the boat.

Due to the amount of torque generated by the propeller, the outboard motor will pivot to a maximum degree in a given direction if the operator or helmsman releases control of the steering wheel. If the steering wheel is released by the helmsman, the boat will lurch and even throw passengers out of the boat. At the same time the boat will be caused to turn wildly in small circles, perhaps even cutting the people who were thrown out of the boat.

In a conventional steering system, at certain revolutions per minute (rpm), the engine creates an extreme amount of force on the steering which results in tiring physical effort to keep the boat on course.

In the past, attempts have been made to overcome the aforementioned problems and difficulties. For example, U.S. Pat. Nos. 3,374,761 and 3,658,027 both purport to solve the problems referred to above; however, both of the foregoing patents involve a control mechanism which is responsive to the mechanical pinching of a tube or hose. Also, both patents involve systems which require drastic modification of the existing steering systems.

Therefore, it is a principal object and purpose of the present invention to provide a control system which overcomes the aforementioned problems and difficulties in a manner superior to any prior art proposals. The control system of the present invention includes, first of all, a hydraulic actuator valve which can be interposed between one end of the cable steering mechanism and the motor arm without requiring any drastic modification of the steering system per se. A locking cylinder, controlled by the hydraulic actuator valve, is connected between the motor arm and another point in the motor well. When there is no controlling force on the steering wheel, and hence, no push or pull on the steering cable, the locking cylinder will hold the motor in a fixed position.

It is a further object and purpose to reduce the helmsmans fatigue that occurs on a long journey due to steering torque fatigue.

It is a further object of the present invention to provide a control system which will eliminate the effect of "play" and/or "backlash" in the steering mechanism.

It is also an object and purpose of this invention to provide a system for safe steering of outboard motors that is readily adaptable to present outboard motor steering systems and is simple in installation.

SUMMARY OF THE INVENTION

The present system for safe steering of outboard motors prevents loss of control of the motor when control of the boat steering wheel is released by the helmsman.

The rear end of a boat contains a motor well in which an outboard motor is pivoted in relation to the boat about a vertical axis. Steering of the boat is effected by a flexible cable enclosed within a sheath which is connected to a steering wheel. Turning the steering wheel in one direction will cause the outboard motor to pivot in a given direction; turning the wheel in an opposite direction will cause the outboard motor to pivot in an opposite direction.

An arm extending from the forward end of the outboard motor is pivotally connected by a motor pin to a link rod. The link rod, in turn, is connected to an actuator control valve. The control valve is connected to the flexible cable.

A hydraulic cylinder is located between a tab in the well of the boat and the arm on the outboard motor. The cylinder is pivotally connected to the arm by means of the motor pivot pin and the piston rod of the cylinder is pivotally connected to the tab by a pivot pin.

The actuator control valve includes a valve body having a central bore there through. A stem is mounted for horizontal sliding movement within the bore. On the lower side of the bore are two external radial ports. Spaces on opposite sides of the piston head communicate with opposite sides of the external radial ports.

Above the central bore are formed three internal radial ports which are interconnected by an internal horizontal passageway opposite the two external ports. The stem is provided with two circumferential recesses in positions opposite the external ports.

One end of the stem passes through an enlarged spring chamber within the valve body. The left-hand end of the spring chamber communicates with a shoulder in the valve body. At one end of the valve body is connected a threaded cap which has an external fitting that is allowed to connect with the link rod. The right-hand end of the spring chamber abuts the threaded cap.

A spring is received on the stem between a pair of spring retainers. The outer diameter of the spring is somewhat less than the opening provided by the chamber and the circumferential flange, respectively.

Movement of the steering wheel places the external ports in communication with the interconnected internal ports, thereby unlocking the cylinder from a hydraulic lock.

The turning of the steering wheel in either direction will unlock the hydraulic cylinder and allow the steering system to behave as it was intended. When the controlling force of the helmsman on the steering wheel is removed, the steering system will again relock.

DETAILED DESCRIPTION OF THE PREFERRED EMBODIMENTS

Figure 1:
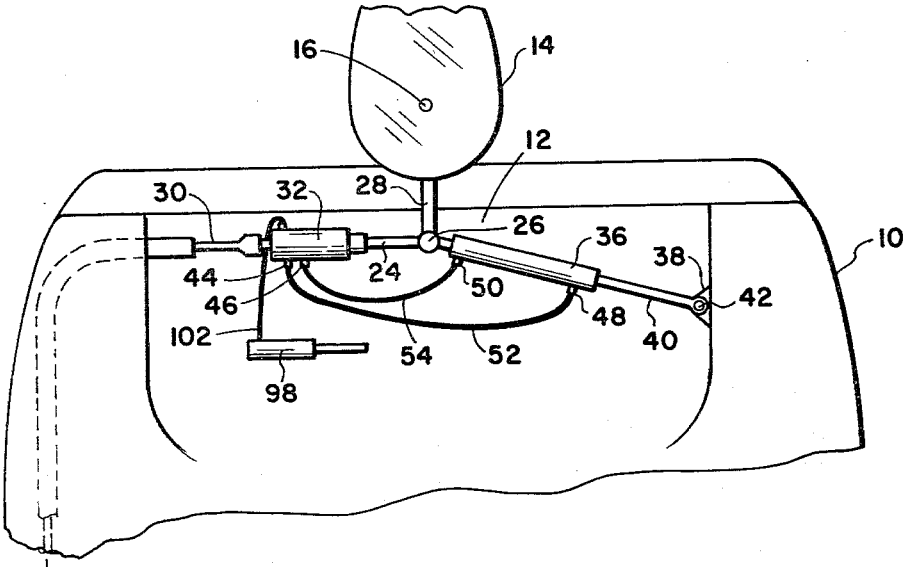
FIG. 1 is a diagrammatic representation of a system for safe steering shown in relation to the stern of a boat constructed in accordance with one embodiment of the present invention.
Figure 3:
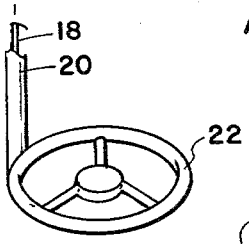
FIG. 3 is a sectional view of an actuator control valve taken along section line 3—3 of FIG. 4 that would be used as a part of the system for safe steering shown in FIG. 1.
Figure 3:
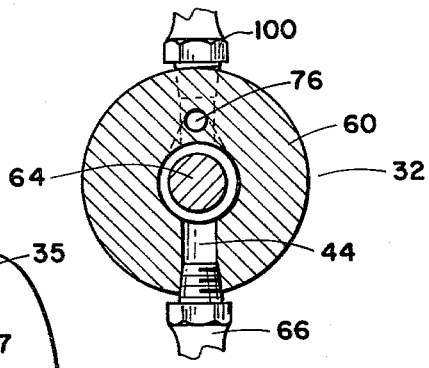

Referring to the drawings in detail, FIGS. 1 through 6 show a system for safe steering of outboard motors. The safety system would prevent an outboard motor from going out of control when the operator or helmsman takes his or her hands off the steering wheel in a small boat which is powered by a steerable outboard motor.

As seen in FIG. 1, the rear end or stern 10 of a boat contains a motor well 12 in which an outboard motor 14 is pivoted in relation to the boat about an axis 16. The motor is allowed to rotate or twist about the axis extending vertically at approximately the center of the stern of the boat. A propeller (not shown) extending from the motor would be located below and would rotate on a horizontal axis (not shown) underneath the water to propel the boat forward.

In operation of a typical steering system without the present invention, steering of the boat is effected by a flexible cable enclosed within a sheath. This type of connection, sometimes referred to as a "Bowden" connection, is similar to the familiar choke in that the cable, encased within the sheath, is capable of exerting a push force as well as a pulling force. One end of the cable would be directly connected to a rod which is pivotally connected by a pin to an arm attached to the forward end of the outboard motor. The other end of the cable is connected to a steering wheel which would be located at the forward end of the boat. Under this arrangement, turning the wheel in one direction will cause the outboard motor 14 to pivot in a given direction; turning the wheel in an opposite direction will cause the outboard motor 14 to pivot in an opposite direction.

Because of the force of the torque generated by the propeller, the outboard motor 14 will pivot to a maximum degree in a given direction if the operator or helmsman takes his hands off the wheel. If the steering wheel is released by the helmsman, the boat will lurch and throw the passengers out of the boat while at the same time causing the boat to turn wildly in small circles, perhaps even cutting the people who were thrown out of the boat.

Figure 2:
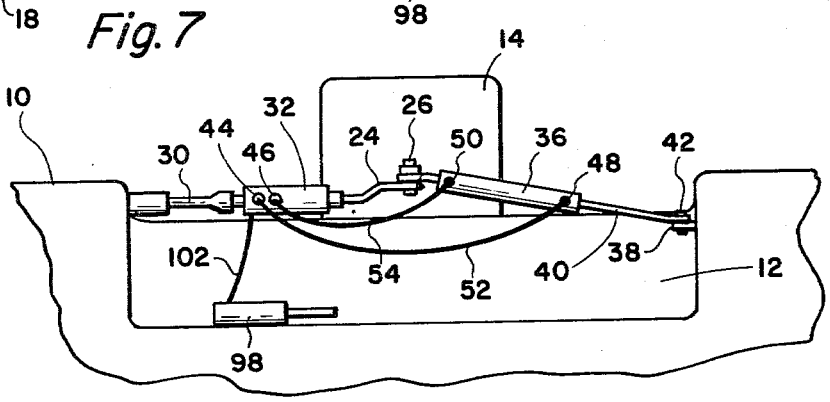
FIG. 2 is a diagrammatic elevation view of the system for safe steering shown in FIG. 1.

FIGS. 1 and 2 show diagrammatically a modification of the above system to prevent the above described difficulties by inclusion of the present invention. A flexible cable 18 is enclosed, as previously described, within a sheath 20. One end of the cable 18 is connected to a steering wheel 22. A rod 24 is pivotally connected by a motor pin 26 to an arm 28 which is attached to the forward end of the outboard motor 14.

The control mechanism is positioned between the arm 28 and the other end of the cable 18. A link rod 30 has a right-hand end, that is connected to a control valve 32 which is connected to the rod 24. The valve is thus installed in the existing steering linkage.

A hydraulic cylinder 36 is connected between a tab 38 in the well 12 of the boat and the arm 28 on the outboard motor 14. One end of the cylinder 36 is pivotally connected to the arm 28 by the pivot pin 26 and the piston rod 40 of the cylinder 36 is pivotally connected to the tab 38 by a pivot pin 42.

The control valve 32, which will be described in greater detail below, is provided with two outlet ports 44 and 46 which connect with the ports 48 and 50 by means of hydraulic hoses 52 and 54, respectively. Hydraulic fluid (not shown) flows within the valve, the hoses, and the cylinder.

The cylinder 36 is a conventional two-way hydraulic cylinder provided with a piston (not shown) which connects with the piston rod 40 and spaces on opposite sides of the piston head communicate with opposite sides of the ports 48 and 50. These spaces constitute first and second chambers of confined liquid within the hydraulic cylinder. As will presently be seen, it is important to note that if ports 48 and 50 were maintained in communication with each other, the piston rod 40 could be moved in and out of the cylinder 36. If, however, ports 48 and 50 were both closed, the piston rod 40 would be locked in whatever position it occupied at the time the ports were closed. Movement of the motor is thus blocked.

FIGS. 3, 4, 5, and 6 show the control valve 32 located between the rod 24 and the link rod 30. The valve includes a valve body 60 having a central bore 62 there through. A stem 64 is mounted for horizontal sliding movement in the bore 62. On the lower side of the bore are two radial ports 44 and 46. External nipples 66 and 68 are threadably connected into the ports 44 and 46 to facilitate connection with the hydraulic hoses 52 and 54 previously described.

Above the central bore 62 are formed three internal radial ports 70, 72, and 74 which are interconnected by an internal horizontal passageway 76. In positions opposite the ports 44 and 46, the stem 64 is provided with circumferential recesses 78 and 80.

The right-hand end of the stem 64 passes through an enlarged spring chamber 82. The right-hand end of the valve body 60 is connected with a threaded cap 88 which has an external fitting 90 which is allowed to connect with the link rod 24.

A preloaded spring 92 is received on the stem 64 between a pair of spring retainers 94 and 96.

Figure 4:
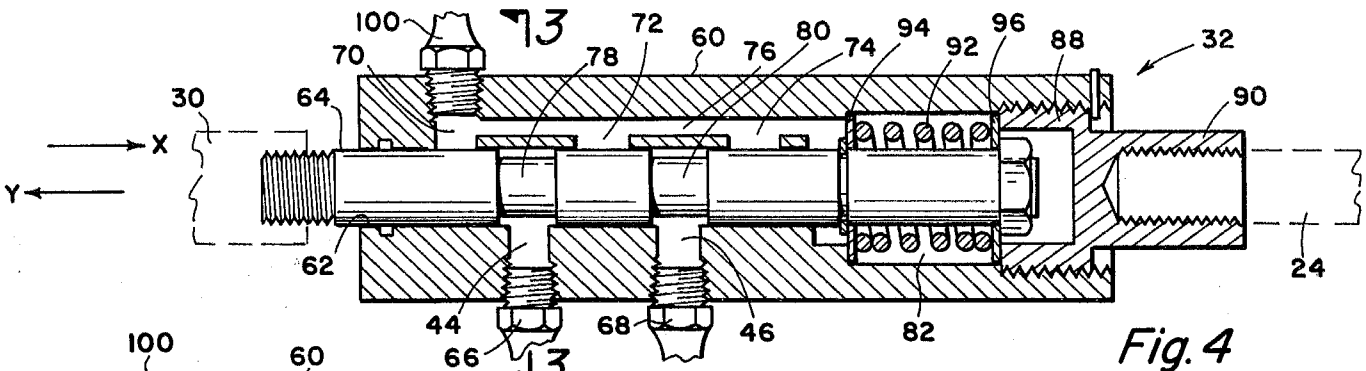
FIG. 4 is a sectional view of the actuator control valve shown in FIG. 3 wherein the valve would have the steering system in a hydraulic lock.
Figure 5:
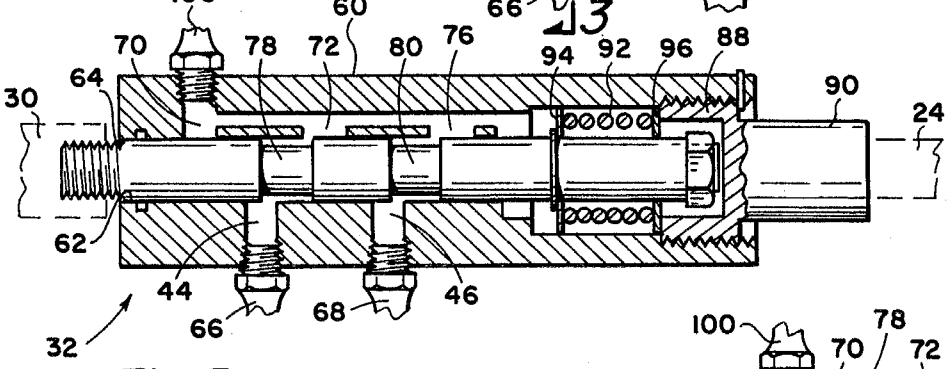
FIG. 5 is a sectional view of the actuator control valve shown in FIG. 3 wherein the valve would be unlocked to one side.

If a force were directed onto the stem 64 in a direction indicated by the arrow "X" as shown in FIG. 4, the stem 64 would be moved toward the right as would the annular spaced recesses 78 and 80, as best seen in FIG. 5. This movement, accomplished by movement of the steering wheel 22, would place the port 44 in communication with the port 72 and, simultaneously, it would place the port 46 in communication with the port 74 thereby unlocking the cylinder 36 from the hydraulic lock referred to above. Continued force in the direction "X" would cause the outboard motor 14 to pivot in a counterclockwise direction. The spring 92 would be compressed between the spring retainer 94 and the threaded cap 88. If the operator or helmsman would release the wheel 22, the spring 92 would urge the stem towards the left, again locking the piston 36 in a fixed position.

Figure 6:
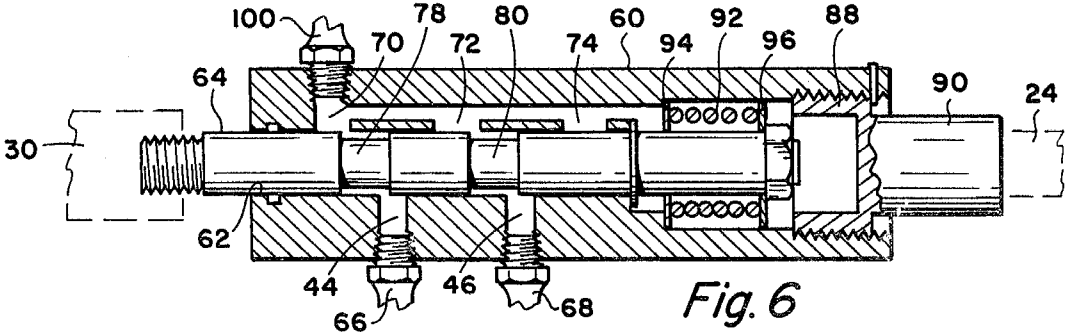
FIG. 6 is a sectional view of the actuator control valve shown in FIG. 3 wherein the valve would be unlocked to the other side.

If the stem 64 were pulled in the direction of the arrow "Y" shown in FIG. 4 through movement of the wheel 22, the annular recess 78 would place the port 44 in communication with the port 70 while, at the same time, the recess 80 would place the port 46 in communication with port 72, thereby unlocking the cylinder 36, as best seen in FIG. 6. Continued pulling in the direction "Y" would cause the outboard motor 14 to pivot or rotate in a clockwise direction. The spring 92 would be compressed between the spring retainer 96 and the shoulder of the chamber 82. Releasing control from the wheel 22 at this point would cause the stem 64 to return to the position shown in FIG. 4. Again, the cylinder 36 would be locked in a fixed position.

Returning to a consideration of FIGS. 1 and 2, an accumulator 98 is in fluid connection with the internal horizontal passageway 76 through an external nipple 100 and an accumulator hose 102. The accumulator would consist of a hydraulic cylinder for use in storing excess hydraulic fluid. The accumulator provides fluid to compensate for the difference in volume of each end of the cylinder. It also pressurizes the safety system, keeping air out and preventing "spongey" steering.

Figure 7:
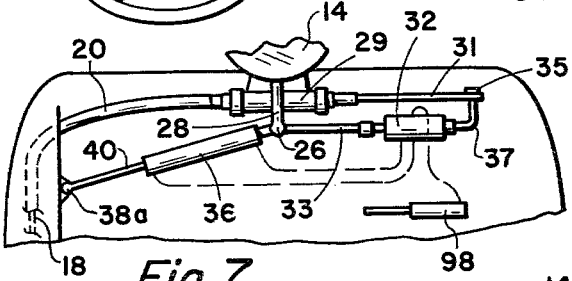
FIG. 7 is a view similar to FIG. 1 showing the same control system of the present invention in relation to a slightly modified steering system.

FIG. 7 shows essentially the same control system of the present invention associated with a modified, and perhaps more up-to-date, steering system. In the FIG. 7 illustration, the sheath 20 is connected to a tube 29 located on a fixed position on the stern of the boat behind the motor 14. An external rod 31 extends through the tube 29 into the sheath 20 and connects with the flexible cable 18. The outer end of the rod 31 is provided with a pivot point or point of connection 35 from which a link (not shown) would normally extend to the pivot point 26 on the motor arm 28 (in the absence of the control system of the present invention). Thus, the control system of the present invention merely involves the replacement of the link (not shown) referred to above. The hydraulic actuator 32, described above, is connected at one end to a rod 33 which, in turn, connects with the arm 28 in the pivot point 26; the opposite end of the actuator 32 connects with an arm 37 which connects with a pivot point 35 on the rod 31 described above. Thus, the actuator 32 and the arms 33 and 37 constitute a simple and easy replacement for the link (not shown) described above which was heretofore employed on the unmodified steering system of the type represented by FIG. 7. To complete the control system so that it operates in the manner described above in relation to FIGS. 1 through 6, a hydraulic cylinder means 36 is connected between a tab 38*a* and the pivot point 26. The hydraulic accumulator 98 is also connected into the system in the same manner described above.

Thus, the turning of the steering wheel 22 in either direction will unlock the hydraulic cylinder 36 and allow the steering system to behave as it was intended. When the controlling force from turning the steering wheel is removed, the steering will again relock. This locked position of the steering mechanism would be such that the boat would continue in a relatively even path.

In the unlikely event that the safety system failed, there would still remain uninterrupted use of the existing steering system.

Whereas, the present invention has been described in particular relation to the drawings attached hereto, it should be understood that other and further modifications of the invention, apart from those shown or suggested herein, may be made within the spirit and scope of this invention.

What is claimed is:

1. A safety steering system to control torque rotation for a boat having directable propeller outboard motor means capable of pivoting about a vertical axis in relation to said boat which comprises a motor arm on said motor perpendicular to said vertical axis for pivoting said motor; steering means to control movement of said motor about said axis; flexible cable means to exert either a push or pull force on said motor arm and having two ends, a first end of said cable means connected to said steering means and a second end of said cable means connected to said arm; actuator control valve means interposed along the connection of said flexible cable means with said motor arm, said control valve means including a first external port and a second external port; a hydraulic cylinder means having pivotal connections at its opposite ends pivotally attached at one end thereof to said boat and pivotally attached at the opposite end thereof to said motor arm, said cylinder means having a first chamber of confined liquid and a second chamber of confined liquid therein; a piston reciprocal within said cylinder means and capable of moving longitudinally therein including a piston head separating said first liquid chamber from said second liquid chamber; a piston rod having one end connected with said piston head and an opposite end constituting one of said pivotal connections on said hydraulic cylinder means; means to conduct said liquid from said first chamber to said first external port; means to conduct said liquid from said second chamber to said second external port; a stem within said control valve means responsive to a push force or a pull force from said cable means to provide fluid communication within said control valve means between said external ports and thus between said first and second chambers, said stem being movable in response to the cessation of said push force or said pull force by release of said steering means to interrupt communication between said ports thereby locking said arm in a single position; and a hydraulic accumulator connected to said control valve means for storing hydraulic fluid therein and for providing fluid to compensate for the difference in volume between said first and second chambers of confined liquid.

2. A safety steering system as set forth in claim 1 wherein said actuator control valve means includes a valve body having a central bore therethrough in fluid communication with said external ports, said stem capable of moving horizontally within said central bore; spring means mounted in said control valve means for moving said stem to a predetermined position when no force is being exerted on said stem by said cable means; a first circumferential recess in said stem aligned only with said first external port when no force is being exerted on said stem; a second circumferential recess in said stem aligned only with said second external port when no force is being exerted on said stem; said stem being offset from said predetermined position against the action of said spring means when a force is being exerted on said stem by said cable means; and a plurality of internal radial ports in said valve body interconnected by an internal passageway, said circumferential recesses communicating with each other through said internal radial ports and said passageway when said stem is offset.

* * * * *